US007945067B2

(12) United States Patent
Mott et al.

(10) Patent No.: US 7,945,067 B2
(45) Date of Patent: May 17, 2011

(54) AUDIO SYSTEM HOUSED BY AN ENCLOSURE WITH A SUBSTANTIALLY WATERPROOF SEAL

(75) Inventors: Shannon R. Mott, Suwanee, GA (US); William Bierbower, Alpharetta, GA (US)

(73) Assignee: Shannon R. Mott, Cumming, GA (US)

( * ) Notice: Subject to any disclaimer, the term of this patent is extended or adjusted under 35 U.S.C. 154(b) by 1191 days.

(21) Appl. No.: 11/539,403

(22) Filed: Oct. 6, 2006

(65) Prior Publication Data

US 2008/0095382 A1 Apr. 24, 2008

(51) Int. Cl.
*H04R 1/02* (2006.01)

(52) U.S. Cl. ..... 381/334; 381/189; 367/131; 320/111; 320/113

(58) Field of Classification Search ..... 381/55, 381/334, 189, 120; 367/131, 141, 165, 173, 367/188; 320/112–113, 107, 111; 307/31, 307/38, 126

See application file for complete search history.

(56) References Cited

U.S. PATENT DOCUMENTS

| | | | | |
|---|---|---|---|---|
| 5,091,700 | A * | 2/1992 | Smith | 330/128 |
| 5,447,041 | A * | 9/1995 | Piechota | 62/457.7 |
| 5,572,592 | A * | 11/1996 | Muckelrath | 381/56 |
| 7,263,032 | B2 * | 8/2007 | Polany et al. | 367/131 |
| 7,353,908 | B1 * | 4/2008 | French | 181/206 |
| 2003/0040296 | A1 * | 2/2003 | Smith | 455/347 |
| 2005/0010315 | A1 * | 1/2005 | Silverman | 700/94 |
| 2005/0268126 | A1 * | 12/2005 | Lee | 713/300 |
| 2007/0201703 | A1 * | 8/2007 | Dorogusker et al. | 381/58 |
| 2007/0242846 | A1 * | 10/2007 | Li et al. | 381/334 |
| 2009/0304217 | A1 * | 12/2009 | Thalheimer et al. | 381/334 |

OTHER PUBLICATIONS

Press Releases http://www.asaelectronics.com/press.html, printed Oct. 25, 2006.

JEBES9425 Backyard Entertainment System, http://www.asaelectronics.com/detail.html?catid=&pid=56, date unknown but believed to exist prior to Oct. 6, 2006.

ASA Introduces JENSEN Backyard Entertainment System, http://www.asaelectronics.com/press.html?a=96, dated Aug. 5, 2005.

JENSEN Backyard Entertainment System, photographs of contents, taken before Oct. 6, 2006.

* cited by examiner

*Primary Examiner* — Devona E Faulk
*Assistant Examiner* — Disler Paul
(74) *Attorney, Agent, or Firm* — Withers & Keys, LLC

(57) ABSTRACT

Audio systems are housed by an enclosure with a substantially waterproof seal such that the audio systems may be mounted in outdoor locations such as decks, boat docks, and the like. The enclosure may include a panel that opens relative to a tub portion, such as by a hinged connection, and a substantially waterproof seal located there between. The audio systems may include one or more various features such as external speaker connections so that speakers may be located distantly from the enclosure. Other features may include internal amplification that may be stand-alone or integrated into an audio signal source such as a radio or compact disc player or combinational device such as an automobile head unit. Additional features may include a power supply that provides power for the amplification and/or audio source, an external cover with a substantially waterproof seal relative to the enclosure, filtered ventilation via an electric fan, and other related features.

4 Claims, 7 Drawing Sheets

AUDIO SYSTEM HOUSED BY AN ENCLOSURE WITH A SUBSTANTIALLY WATERPROOF SEAL

TECHNICAL FIELD

Embodiments are related to audio systems for audio playback. More particularly, embodiments are related to audio systems housed by an enclosure with a substantially waterproof seal.

BACKGROUND

Audio systems are used by individuals for the playback of audio content such as music, audible books, presentations, etc. Audio systems are found in homes, commercial buildings, and most forms of vehicles and generally include some form of an audio signal source, amplification for the audio signal, and speakers that produce sound based on the audio signal. Heretofore, audio systems have been primarily for indoor use as the sensitive electronics of the signal source and amplification are vulnerable to adverse weather conditions experienced in outdoor settings.

For individuals desiring audio in outdoor settings, the audio system is typically located permanently indoors and the amplified audio signal is transferred via wiring or special wireless connectivity to outdoor speakers located at the desired outdoor location. This results in an inconvenience to the listeners because there is they typically have no control over the audio being played through the speakers other than to return indoors to the location of the audio system where an adjustment can be made. Thus, tasks such as switching to a different song, compact disc, radio station, volume setting, and the like becomes burdensome.

SUMMARY

Embodiments address these issues and others by providing an audio system within an enclosure that includes a substantially waterproof seal such that the audio system may be located in an outdoor setting where the listeners will be. Thus, adjustment may be made outdoors at the location where listening is occurring rather than returning indoors to a location of an indoor audio system.

One embodiment is an audio system that includes an enclosure having a substantially waterproof seal. The audio system further includes an amplifier within the enclosure, the amplifier having an electrical audio signal input and an audio signal output, the audio signal output being exposed to an exterior of the enclosure through a substantially waterproof port. An audio signal source provides an audio signal to the audio signal input of the amplifier.

Another embodiment is an audio system that includes an enclosure having a hinged panel, a tub portion, and a substantially waterproof seal between the hinged panel and the tub portion. An amplifier is located within the enclosure, and the amplifier has an audio signal input, and an audio signal output. An audio signal source is fixed to the hinged panel and provides an audio signal to the audio signal input of the amplifier, the audio signal source being exposed externally of the enclosure. A cover is affixed to the hinged panel of the enclosure and encloses the exposed audio signal source. The cover has a substantially waterproof seal relative to the enclosure, and the cover has a first position whereby the audio signal source is exposed to an ambient and has a second position whereby the cover maintains a substantially waterproof engagement to the enclosure such that the audio signal source is isolated from the ambient.

Another embodiment is an audio system that includes an enclosure having a substantially waterproof seal. A computer power supply is attached to a wall of the enclosure and has a plurality of power outputs. An amplifier is located within the enclosure, and the amplifier has an audio signal input and an audio signal output. The amplifier has a power input that draws power from at least one of the plurality of power outputs of the computer power supply. An audio signal source provides an audio signal to the audio signal input of the amplifier.

Another embodiment is an audio system that includes an enclosure having a hinged panel, a tub portion, and a substantially waterproof seal between the hinged panel and the tub portion. An automobile audio head unit is located within the enclosure, is fixed to the hinged panel, and has a power input. A power supply within the enclosure supplies power to the power input of the automobile audio head unit.

Another embodiment is an audio system that includes an enclosure having a substantially waterproof seal and at least two apertures. An amplifier is located within the enclosure, and the amplifier has an audio signal input and an audio signal output. An audio signal source provides an audio signal to the audio signal input of the amplifier. A first louvered cover is disposed in a first of the at least two apertures and a second louvered cover is disposed in a second of the at least two apertures. An electric fan is located within the enclosure and in alignment with the first louvered cover.

DETAILED DESCRIPTION

Embodiments provide audio systems that have enclosures having substantially waterproof seals so that the enclosures may be positioned in outdoor settings, thereby giving individuals local control of the audio output. Thus, the listener is no longer burdened with returning indoors to make adjustments to the audio system. Instead, the user may make adjustments directly to the audio system in the outdoor setting.

Figure 1:
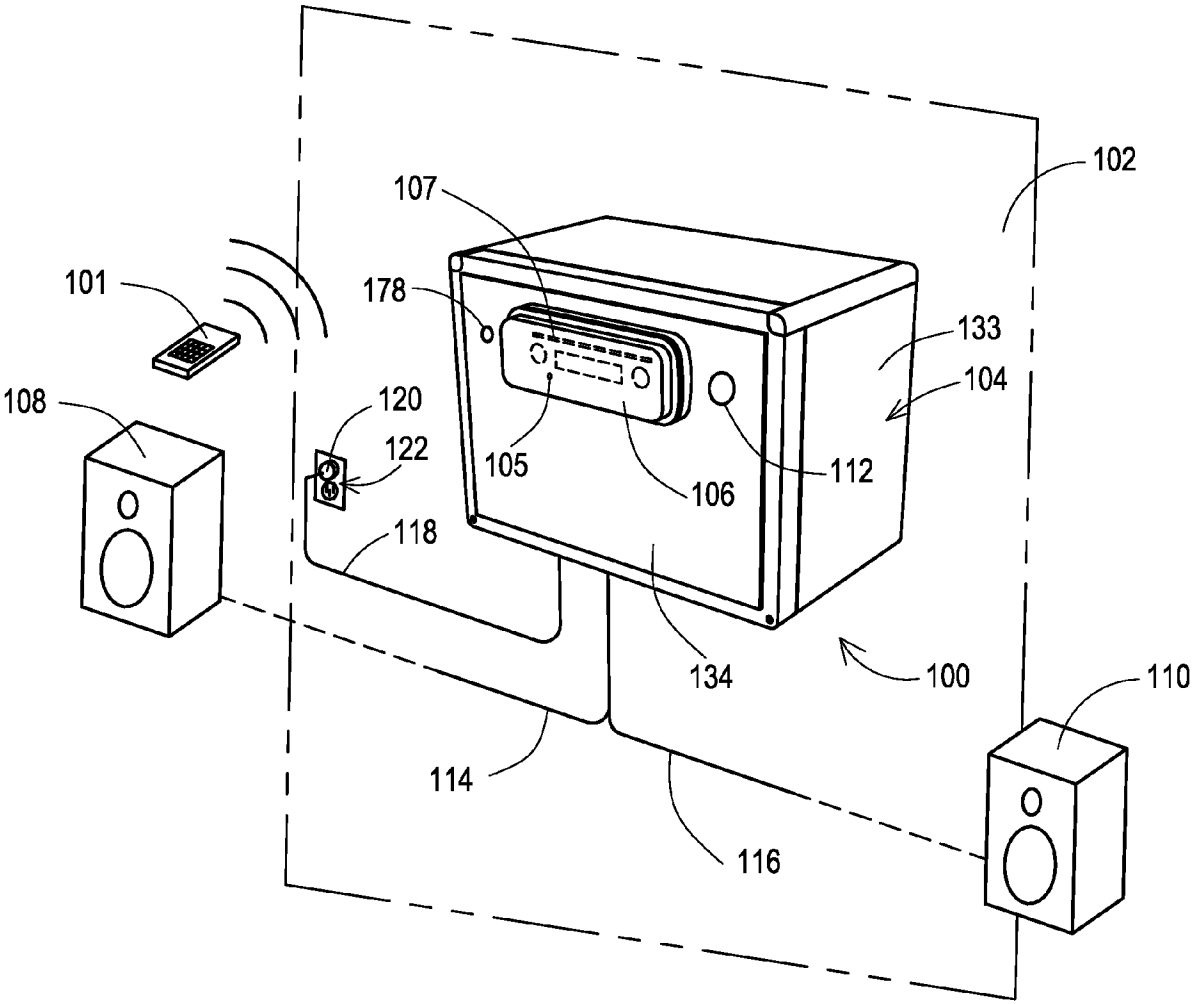
FIG. 1 shows a perspective view of one embodiment of an audio system.

An embodiment is shown in FIG. 1. The audio system 100 is mounted to an exterior wall 102 of a building such as a home. The audio system 100 includes an enclosure 104. The enclosure 104 includes one or more substantially waterproof seals so that moisture is prevented from entering the enclosure 104. As used herein, substantially waterproof refers to a seal that at the least prevents moisture from surrounding weather conditions from permeating the seal and reaching the interior of the enclosure. The one or more substantially waterproof seals may be included at locations on the enclosure 104 where there would otherwise be exposure, such as at the junction of panels that may open to reveal the interior. Discussion of such panels and the substantially waterproof seals are discussed below in relation to FIG. 2.

The enclosure 104 may be made of various materials. For example, the enclosure may be made of various woods, metals, and/or plastics. However, to prolong the life of the enclosure 104 in outdoor settings, it may be desirable for the exterior to either be a weather resistant material or be coated with a weather resistant coating. Furthermore, it may be desirable to utilize an enclosure 104 that is non-conducting to reduce the likelihood of electrical shocks to individuals that come into contact with the enclosure 104. In the embodiment shown, the enclosure 104 is fiberglass, such as the model DWG48461513 manufactured by Stahlin Enclosures of Belding, Mich., which provides both a weather resistant and non-conducting enclosure 104. The fiberglass may include UV inhibitors to help retain the color of the fiberglass over time as the enclosure 104 is exposed to ambient sunlight on a daily basis.

The enclosure 104 houses various components of the audio system. In the illustrative embodiment shown in FIG. 1, an audio signal source device 106 is shown as being included within the enclosure 104 and being exposed to the exterior of the enclosure 104. The audio signal source device 106 of this example is an automobile head unit that includes an integrated compact disc player 107 as well as an integrated AM/FM radio and an auxiliary input jack 105. For example, the automobile head unit may be a model CQ-C1330U manufactured by Panasonic Corp. of Secaucus, N.J. In this particular embodiment, a remote control 101 is included that provides for control of the automobile head unit 106. As discussed below in relation to FIG. 4, in this particular embodiment the enclosure 104 also houses a power supply and an amplifier that is integrated into the automobile head unit 106, where the power supply of this embodiment receives AC power via power cable 118 which terminates at a power plug 120 that plugs into an AC wall jack 122.

In this particular embodiment, the internal amplification provides an audio output that is exposed externally of the enclosure 104 via speaker wires 114, 116 that extend from the enclosure 104 to external speakers 108, 110. The external speakers may be located distantly from the enclosure 104 to provide better stereo separation and imaging. Furthermore, while two speakers are shown for purposes of illustration, it will be appreciated that any number of speakers may be provided externally of the enclosure in accordance with the internal amplification, such as to provide only a mono signal with a single speaker, to provide a front/rear fader control in addition to a left/right balance control with four speakers, and/or to provide for surround sound. Additionally, it will be appreciated that in these or other embodiments, speakers may be located internally to the enclosure 104.

Additional features may also be provided. As shown in FIG. 1, an external weather resistant power switch 178 may be included, and example of which is the APEM IPR1FAD2 model by APEM Components, Inc. of Haverhill, Mass. For embodiments, where the internal components such as the amplification or heat unit has its own power switch, the power switch 178 may be used as an alternative manner of turning off the power. Furthermore, power switch 178 may be used to also power down at least a portion of the internal power supply for those embodiments that include one in order to conserve energy when the audio system 100 is not in use. As discussed below, the power supply may at least maintain power to memory circuits of integral components so that the memorized settings are maintained upon turning the power off via the power switch 178.

Another additional feature includes a DC power socket 112, an example of which is the Marinco 12VCR.OEM by Marinco of Napa, Calif. For those embodiments where the input power is AC, the power supply generates DC power to power the internal components and the power socket 112 may receive power from one of the power supply outputs, as discussed in more detail with reference to FIG. 6. The DC power socket may be used to power portable music players that may provide an audio signal through the auxiliary jack 105. The DC power socket may be used for other purposes as well, such as to charge a cellular telephone.

Figure 2:
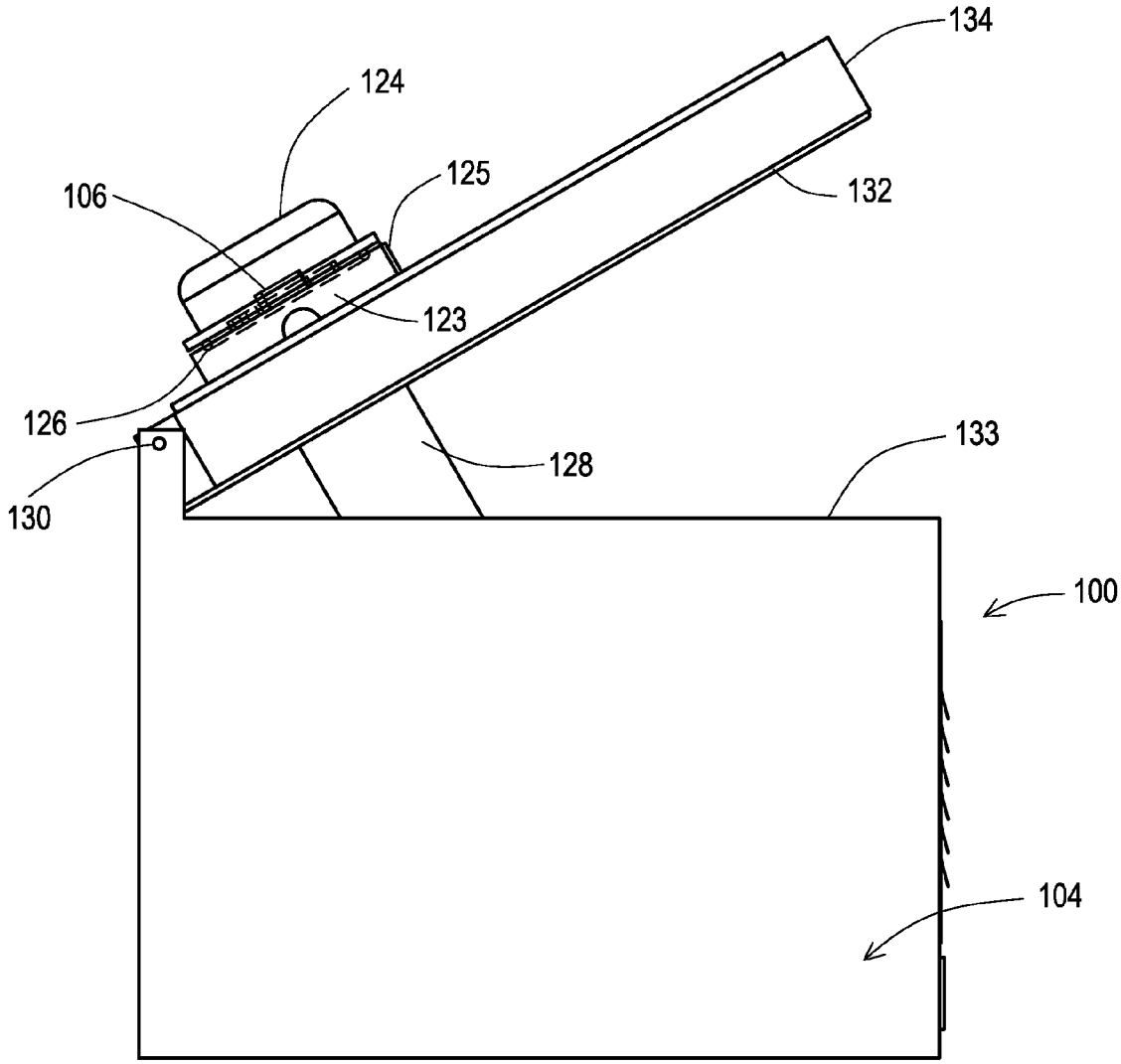
FIG. 2 shows a side view of one embodiment with a hinged panel being opened.

FIG. 2 shows a side view of the enclosure 104 laid on its back wall with a front panel 134 partially opened. In this embodiment, the front panel 134 is hingedly connected to a tub portion 133 of the enclosure 104 at hinge point 130. In order to provide the substantially waterproof seal between the hinged panel 134 and the tub portion 133, a rubber gasket 132 is positioned between the edges of the hinged panel 134 and tub portion 133 that mate when the hinged panel 134 is closed. As shown in this example, the rubber gasket 132 is affixed to the outer edge of the hinged panel 134 but it will be appreciated that such a gasket may remain fixed to the tub portion 133 or may not be fixed to either piece but is positioned between them when closing the hinged panel 134.

A cover 124 is also visible in FIG. 2. This cover 124 encloses the faceplate of the automobile head unit 106 to thereby isolate it from the ambient. The cover 124 may be detached or pivoted by pressing a release button 125 which releases the cover 124 from a catch within a cover frame 123. A rubber gasket 126 is positioned between the cover frame 123 and the edge of the cover 124 to provide a substantially waterproof seal of the cover 124 to the enclosure 104. An example of the cover is the 99-9005B model from Metra Electronics of Holly Hill, Fla.

The ability to open or otherwise remove the panel 134 from the tub portion 133 allows the components and features present within the enclosure 104 to be accessed such as when manufacturing the unit, when installing the unit, and when servicing the unit. The rear section 128 of the automobile head unit 106 can be seen in FIG. 2 as it is exposed upon opening panel 134. As shown in FIGS. 1 and/or 2, the head unit 106, power switch 178 and power socket 112 are installed on the hinged panel 134 such that by hinging open panel 134 or otherwise removing it, these items are at least partially removed from within the tub portion 133 of the enclosure 104.

Figure 3:
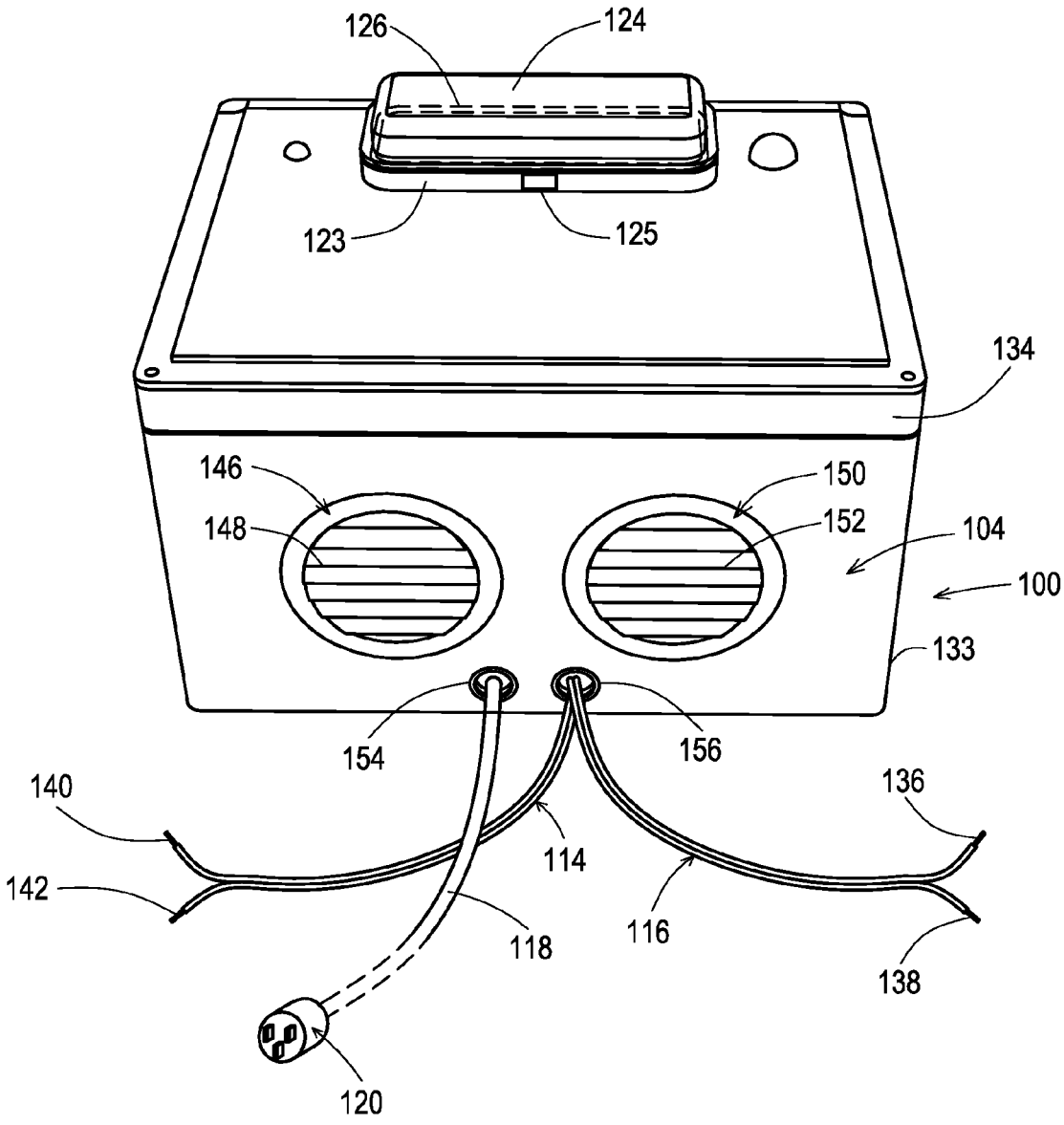
FIG. 3 shows a perspective view of one embodiment with the bottom features being visible.

FIG. 3 shows a perspective view that reveals details of a bottom wall of the enclosure 104 of this particular embodiment. The bottom wall includes multiple apertures allowing for the input of power, the output of amplified audio signals, and for intake and exhaust ventilation. A first pass-through fitting 154 allows an AC power cable 118 to exit the enclosure 104 while a second pass-through fitting 156 allows a collection of speaker cables 114, 116 to exit the enclosure 104. The pass-through fittings provide a port through which the cables can exit but also allow a sealant, such as an outdoor rated silicone sealant, to be applied to provide a substantially waterproof port.

Also shown in FIG. 3, ventilation ports 146 and 150 are provided in this embodiment to allow cooling of the interior of the enclosure 104. In this example, the ventilation ports 146, 150 are covers having louvers 148, 152 which help to divert water away from the interior of the enclosure 104, such as when an individual is spraying water onto the enclosure to wash it as well as when rain and other moisture is blown onto the underside. Examples of such louvered covers are the 5 inch stainless steel model 331425 by Sea-Dog of Everett, Wash.

Additionally, FIG. 3 shows the speaker cables 114, 116 have two conductors each, 140, 142 and 136, 138. These conductors can be plugged into the appropriate positive and negative terminals of the speakers 108, 110. As is well known in the art, for a desired performance, the maximum length of the speaker wires is limited by the gauge of the speaker wire in relation to the amount of current to be carried, hence by the power output of the amplification for the rated impedance of the speakers 108, 110. Generally speaking, the larger conductors (lower gauge number) result in less impedance so that more power is provided to the speakers 108, 110.

Figure 4:
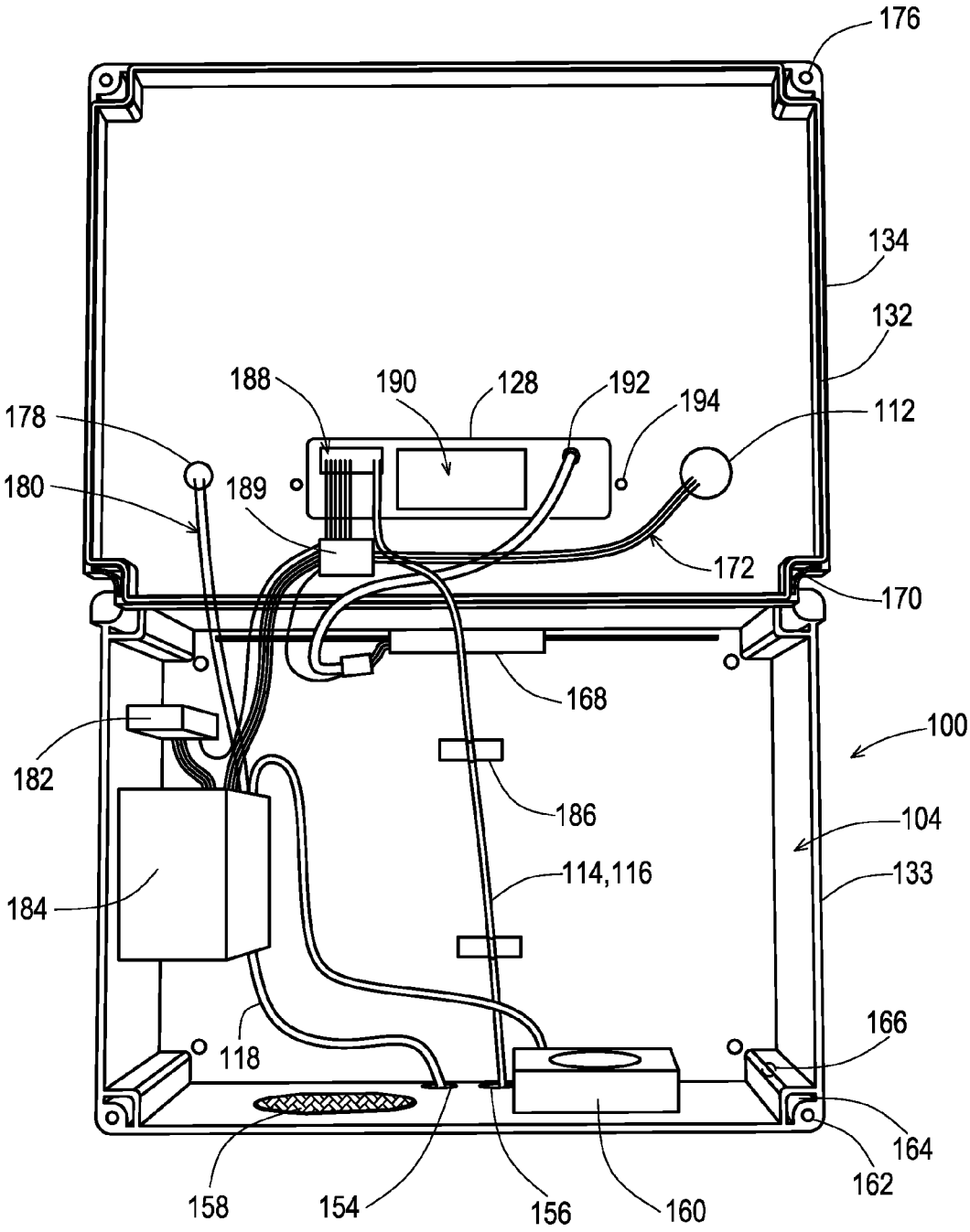
FIG. 4 shows a perspective front view of one embodiment with a hinged panel being opened.

FIG. 4 shows a view of the inside of the enclosure 104 of this particular embodiment where various components and features can be seen. The hinged panel 134 has been hinged about its hinge point 130 so that the back side of panel 134 is visible as is the back side of the power switch 178, rear portion 128 of the head unit 106, and the power socket 112. The rubber gasket 132 surrounding the outer edge of the panel 134 is also shown.

Regarding the enclosure 104, and particularly the tub portion 133, channels 164 on each of the corners provides access to mounting holes 166 within the channels where those mounting holes 166 are placed outside of the gasket 132. Thus, to the extent that water might leak via the mounting holes 166, the water is trapped within the channels 166 outside the substantially waterproof barrier of the gasket 132 to provide added protection from the outdoor weather conditions. Similar channels are located within the corners of the hinged panel 134 on the outside of the gasket 132. To hold the hinged panel 134 tightly to the tub portion 133, screw holes 176 in the end of the hinged panel align with receiving holes 162 of the tub portion, to the outside of the gasket 132, such that the hinged panel 134 is firmly held in place to the tub portion 133 with the gasket 134 located there between.

Regarding ventilation of the enclosure 104, the intake vent 150 has aligned with it an electric fan 160, such as the model Antec Pro 80MM DBB manufactured by Antec of Fremont, Calif. A filter, such as one constructed of self-charging electrostatic material may be placed between the vent 150 and the fan 160 so prevent contaminants from being drawn into the interior by the fan 160 and to provide an additional barrier against moisture. Likewise, a filter 158 may be placed over the exhaust vent 146 to also prevent contaminants and moisture from entering the enclosure 104, particularly during times when the fan 160 is not running and therefore, not exhausting air through vent 146.

The rear portion of the head unit 106 is seen. The amplifier, represented by heat sink 190, is integral to the head unit 106 in the embodiment. As will be appreciated, the amplifier could be a stand-alone amplifier included within the enclosure, either with or without a head unit 106. The head unit 106 is held in place by mounting screws 194. The rear portion 128 includes a wiring connector 188 from which a wiring that leads to a wiring bundle 189 extends. The rear portion 128 also includes an antenna connector cable 192 that extends to an antenna 168, in this example, a powered antenna such as the model 44-UA200 manufactured by Metra Electronics of Holly Hill, Fla.

The wiring from the connector 188, wiring 172 of power socket, wiring 180 of switch 178, etc. may be bundled in order to reduce wiring clutter within the enclosure 104 but the wiring connections themselves are set forth in the circuit schematic of FIG. 6 and are discussed in more detail below.

Figure 6:
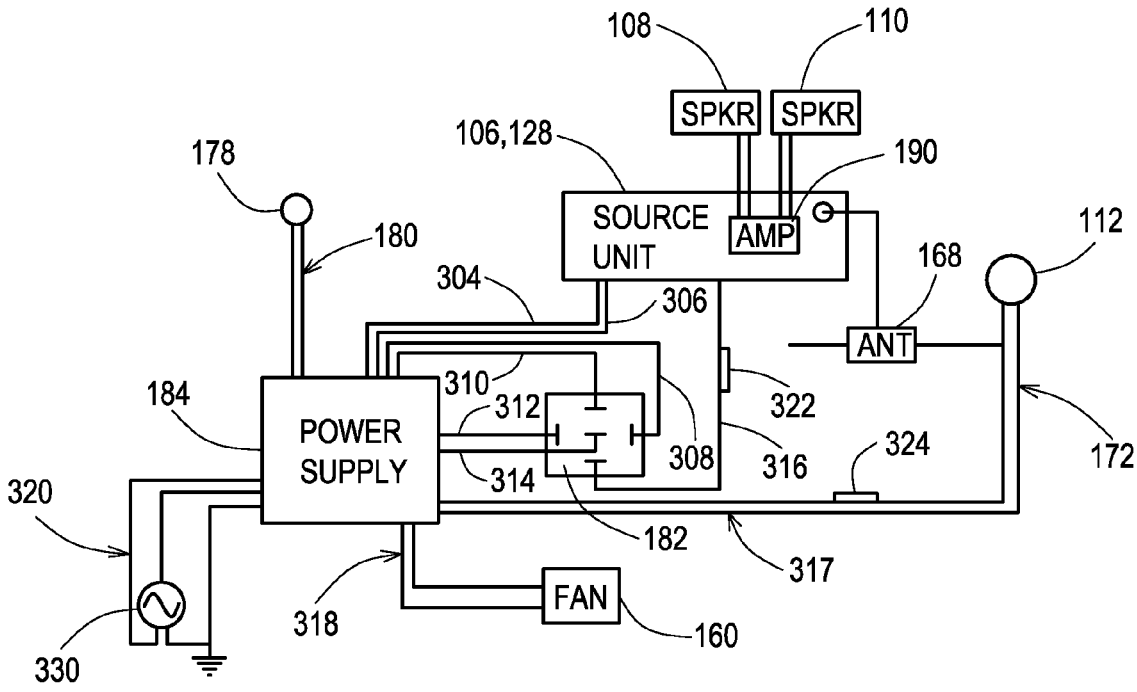
FIG. 6 shows a circuit schematic of one embodiment.

As discussed in relation to FIG. 6, this particular example includes an AC-to-DC power supply 184 and a relay circuit 182. These components are fixed to the side wall of the tub portion 133 of the enclosure 104, such as by screws or double-sided tape. The speaker cables 114, 116 are held in place by cable clips 186 that are fixed to the back wall of the tub portion 133.

As can be seen in FIG. 4, the electrical components are located in elevated positions relative to the bottom wall of the enclosure 104. Furthermore, the openings for the ventilation and passage of the wires are located on the bottom wall. Thus, should moisture enter the enclosure 104, gravity will assist in keeping the moisture at the bottom wall, away from the electrical components and where the moisture is more likely to be evaporated or absorbed.

Figure 7:
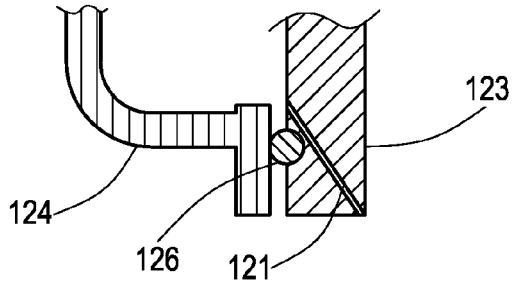
FIG. 7 shows a cross-sectional view of a cover assembly of an embodiment.

As can be seen in the cross-sectional view of FIG. 7, the frame 123 may include angled drainage holes 121 in case moisture gets inside the cover 124, such as if the cover is inadvertently left open during a weather event or is otherwise not properly closed. The angled draining holes 121 collect the water at the bottom of the cover 124 and then direct the moisture downward toward the bottom wall of the enclosure 104.

Figure 5A:
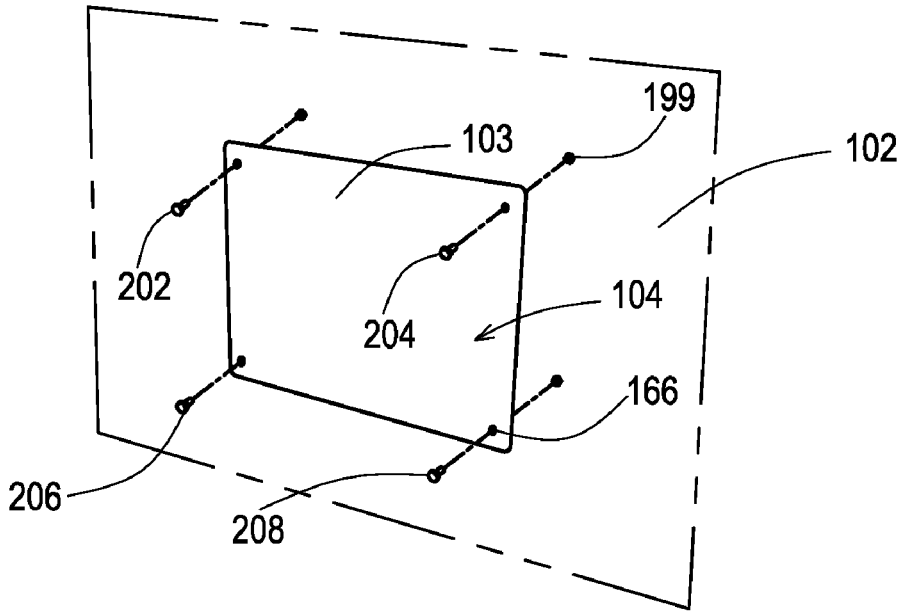
FIG. 5A shows a perspective view of the mounting of a back wall of the enclosure of an embodiment to a wall.

Various mounting options are available for embodiments of the audio system 100. For the particular embodiment shown, three variations are set forth in FIGS. 5A-C. FIG. 5A shows a first mounting option whereby the enclosure 104 is mounted to a vertical wall 102. Screws 202 are inserted through the channels 164 and into the holes 166 in the back wall of the tub portion 133 of enclosure 104 and are seated into holes 199 in the vertical wall. The holes 199 may be pre-drilled using a template setting forth the proper location for each.

Figure 5B:
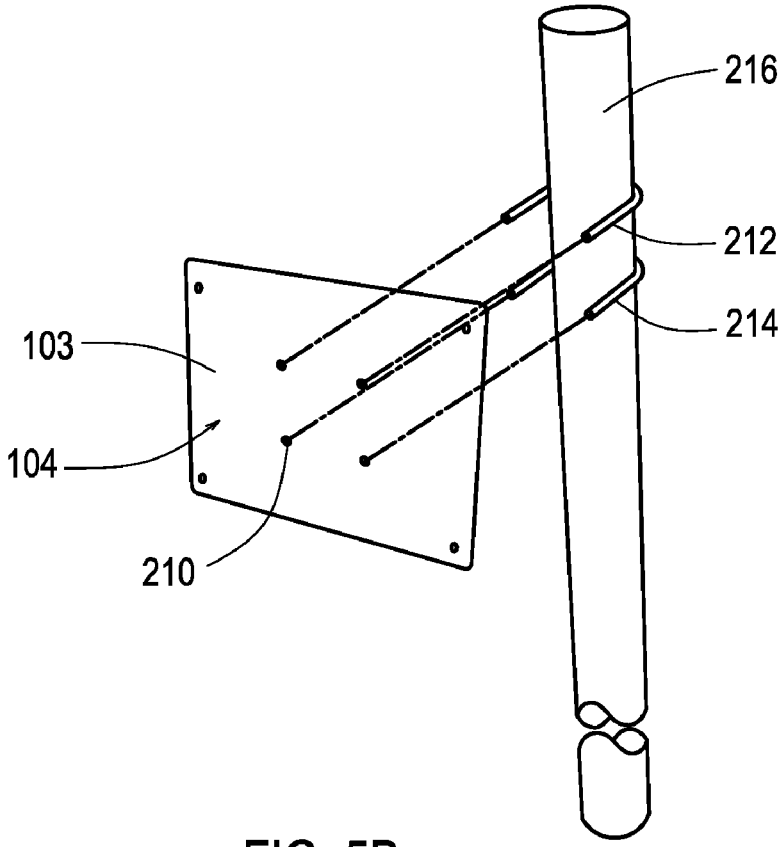
FIG. 5B shows a perspective view of the mounting of a back wall of the enclosure of an embodiment to a post.

FIG. 5B shows a second mounting option involving mounting to a post or pole 216. For this option, U-shaped bolts 212, 214 are used. New holes 210 are drilled in the back wall of the tub portion 103. The U-shaped bolts 212, 214 are then wrapped around the pole 216 and inserted into the holes 210 where the back wall is then secured to the U-shaped bolts 212, 214.

Figure 5C:
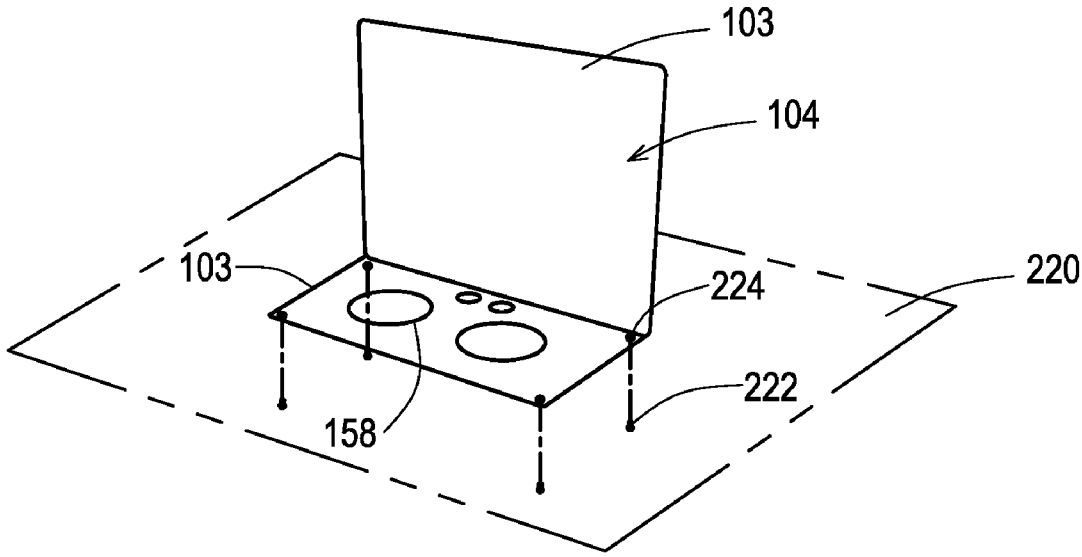
FIG. 5C shows a perspective view of the mounting of a bottom wall of the enclosure of an embodiment to a horizontal surface.

FIG. 5C shows a third mounting option involving using feet 222 on the bottom wall to enable the enclosure 104 to stand on a horizontal surface 220. The feet 222 elevate the bottom wall of the tub portion 103 above the surface 220 to allow for external power wire and speaker wire clearance and to also allow for ventilation clearance. The feet 222 are held in place by screws seated in holes 224 in the bottom wall.

FIG. 6 shows a wiring schematic for one example of an audio system 100 that utilizes an AC-to-DC power supply 184, and in particular, a version of an ATX computer power supply such as the ATXPOWER300 model capable of producing 300 watts and manufactured by StarTech.com of Groveport, Ohio. It will be appreciated that various AC-to-DC converters could be used to generate the DC power. However, the ATX computer power supply provides many protection circuits including over voltage, over current, over temperature, etc. Furthermore, it will be appreciated that in other embodiments, the power supply may be a battery, such as a deep cycle 12V battery that may be contained within the enclosure 104 or may be located externally.

This example also utilizes an automobile head unit 106 to provide the audio signal source (i.e., radio/CD/auxiliary jack) and the amplifier 190. As discussed, the input signal source and amplification may vary. For example, the amplifier may be a stand-alone amplifier while the audio signal source may be an auxiliary input jack of the enclosure receiving a signal being output by an external device such as a portable mp3 player.

The power supply 184 of this example receives AC power, e.g., a 110V AC supply 330 from the public utility via inputs 320 corresponding to the conductors of power cable 118. The power supply 184 converts the AC power to DC power and provides the DC power over four switched 12V outputs, 2 regular and 2 higher current (PSII), over an unswitched 5V standby output, and with 2 higher current grounds (PSII) as well as regular grounds. In this particular example, the precision 12V line 310 and the 5V output line 314 are fed to the switched inputs of the relay 182. A standard 12V output line 308 and ground line 312 are fed to the trigger on the relay 182. The constant hot connection 316 of the head unit 106 is connected to the output of the relay 182 and includes an in-line fuse 322. An example of the relay is the MR76 model by Bosch Corporation of Broadview, Ill. and distributed as the 75111 by Waytek, Inc. of Chanhassen, Minn.

Thus, when the power supply 184 is off based on the switch 178 and related conductor pair 180, no voltage is applied to the trigger of the relay 182 such that the 5V standby output line 314 is connected to the constant hot line 316 of the head unit 106 to thereby maintain the memory settings while the audio system 100 is shut off and not in use. However, upon the user switching the power supply 184 on via the switch 178, the trigger of the relay 182 receives 12V power which causes the relay 182 to switch from the 5V output line 314 to the 12V high current line 310 as being connected to the constant hot line 316 so that the head unit 106 receives adequate voltage to function.

The head unit 106 also receives various other connections. For example, the switched voltage input may be connected to another 12V output line 306 of the power supply 184. The ground of the head unit 106 may be connected to one of the grounds of the power supply 184, such as the precision ground line 304.

Other 12V output lines of the power supply 184 may be connected to the various other features and components. A 12V power and ground conductor pair 317 may be connected to the 12V socket wiring 172 which may include an in-line fuse 324. The 12V power and ground may be a high current 12V output. Likewise, a 12V power and ground conductor pair 318 may be connected to the power input of the electric fan 160. Furthermore, the antenna 168 connected to the antenna connector of the head unit 106 may be a powered antenna such that a power input of the antenna 168 is connected to one of the 12V power outputs, such as being connected in parallel with the socket 112 to a 12V power output. The antenna 168 may obtain its ground connection through the ground connection of the antenna connector of the head unit 106.

It will be appreciated that the particular voltages discussed above are merely for purposes of illustration. The voltages may vary depending upon the requirements of the components included in the audio system. Furthermore, it will be appreciated that the components may be integrated. For example, the AC/DC power supply may be integrated together with a head unit rather than existing within the enclosure as distinct components. As another example, the faceplate of the audio head unit may be separate from a main chassis of the head unit such that the faceplate may be positioned on the enclosure wall while the main chassis is located elsewhere within the enclosure.

Accordingly, embodiments of an audio system suitable for outdoor installation have been described. These embodiments provide for an enclosure that protects the interior components from weather and other ambient conditions such that the audio system may be permanently mounted in the outdoor setting. As such, the users of the audio system are relieved from the burdens associated with using indoor audio systems to produce audio in outdoor locations.

While illustrative embodiments have been particularly shown and described, it will be understood by those skilled in the art that various other changes in the form and details may be made therein without departing from the spirit and scope of the invention.

What is claimed is:

1. An audio system, comprising:

an enclosure having a substantially waterproof seal;

an amplifier within the enclosure, the amplifier having an electrical audio signal input and an audio signal output, the audio signal output being exposed to an exterior of the enclosure through a substantially waterproof port by an audio cable that has a first end electrically coupled to the amplifier within the enclosure passing through the substantially waterproof port such that a second end of the audio cable is present outside of the enclosure;

an audio signal source providing an audio signal to the audio signal input of the amplifier;

a power supply wherein the power supply is mounted within the enclosure;

wherein the amplifier comprises a power input, wherein the power supply is an AC/DC power supply, wherein an AC input is exposed to an exterior of the enclosure through a substantially waterproof port, and wherein a DC output is interconnected to the power input of the amplifier;

wherein the power supply is an ATX computer power supply; and the audio system further comprising a relay, wherein the audio source comprises an audio head unit having a constant voltage input and a switched voltage input, wherein the ATX computer power supply comprises a constant first voltage level output and a switched second voltage level output, wherein the constant first voltage level output and the switched second voltage level output are connected to switched inputs of the relay, wherein the second voltage level output is connected to a trigger of the relay such that when the second voltage level output is switched off, the relay supplies the first voltage output to the constant voltage input of the audio head unit and when the second voltage level output is switched on, the relay supplies the second voltage level output to the constant voltage input of the audio head unit.

2. An audio system, comprising:

an enclosure having a hinged panel, a tub portion, and a substantially waterproof seal between the hinged panel and the tub portion;

an amplifier within the enclosure, the amplifier having an audio signal input, and an audio signal output;

at least a portion of an audio signal source fixed to the hinged panel providing an audio signal to the audio signal input of the amplifier, at least a portion of the audio signal source being exposed externally of the enclosure, and at least a portion of the audio signal source being contained within the tub portion when the hinged panel is closed against the tub portion;

a cover affixed to the hinged panel of the enclosure and enclosing the exposed audio signal source, the cover having a waterproof seal relative to the enclosure, the cover having a first position whereby the audio signal source is exposed to an ambient and having a second position whereby the cover maintains a substantially waterproof engagement to the enclosure such that the audio signal source is isolated from the ambient;

a power supply wherein the power supply is mounted within the enclosure;

wherein the amplifier comprises a power input, wherein the power supply is an AC/DC power supply, wherein an AC input is exposed to an exterior of the enclosure, and wherein a DC output is interconnected to the power input of the amplifier;

wherein the power supply is an ATX computer power supply; and the audio system further comprising a relay, wherein the audio source comprises an audio head unit having a constant voltage input and a switched voltage input, wherein the ATX computer power supply comprises a constant first voltage level output and a switched second voltage level output, wherein the constant first voltage level output and the switched second voltage level output are connected to switched inputs of the relay, wherein the second voltage level output is connected to a trigger of the relay such that when the second voltage level output is switched off, the relay supplies the first voltage level output to the constant voltage input of the audio head unit and when the second voltage level output is switched on, the relay supplies the second voltage level output to the constant voltage input of the audio head unit.

3. An audio system, comprising:

an enclosure having a hinged panel, a tub portion, and a substantially waterproof seal between the hinged panel and the tub portion;

an audio unit within the enclosure and with at least a portion of the audio unit fixed to the hinged panel and having a power input, at least a portion of the audio unit being contained within the tub portion when the hinged panel is closed against the tub portion; and a power supply within the enclosure supplying power to the power input of the audio unit;

wherein the power supply is an AC/DC power supply; and the audio system further comprising a relay, wherein the audio unit has a constant voltage input and a switched voltage input, wherein the power supply comprises a constant first voltage level output and a switched second voltage level output, wherein the constant first voltage level output and the switched second voltage level output are connected to switched inputs of the relay, wherein the second voltage level output is connected to a trigger of the relay such that when the second voltage level output is switched off, the relay supplies the first voltage level output to the constant voltage input of the audio unit and when the second voltage level output is switched on, the relay supplies the second voltage level output to the constant voltage input of the audio unit.

4. An audio system, comprising:

an enclosure having a substantially waterproof seal;

an audio unit;

a power supply; and a relay;

wherein the audio unit has a constant voltage input and a switched voltage input, wherein the power supply comprises a constant first voltage level output and a switched second voltage level output, wherein the constant first voltage level output and the switched second voltage level output are connected to switched inputs of the relay, wherein the second voltage level output is connected to a trigger of the relay such that when the second voltage level output is switched off, the relay supplies the first voltage output to the constant voltage input of the audio unit and when the second voltage level output is switched on, the relay supplies the second voltage level output to the constant voltage input of the audio unit.

* * * * *